US007758276B2

(12) United States Patent
Miura

(10) Patent No.: US 7,758,276 B2
(45) Date of Patent: Jul. 20, 2010

(54) ADJOINING EXPANSION STRUCTURE

(75) Inventor: Shinsuke Miura, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 264 days.

(21) Appl. No.: 11/851,157

(22) Filed: Sep. 6, 2007

(65) Prior Publication Data

US 2008/0138147 A1 Jun. 12, 2008

(30) Foreign Application Priority Data

Sep. 11, 2006 (JP) ..... 2006-245047

(51) Int. Cl.
*H05K 7/14* (2006.01)

(52) U.S. Cl. ..... 403/321; 361/726

(58) Field of Classification Search ..... 403/321, 403/353; 361/724, 725, 726, 727; 312/107, 312/108, 111, 198; 206/508, 509
See application file for complete search history.

(56) References Cited

U.S. PATENT DOCUMENTS

| | | | | |
|---|---|---|---|---|
| 2,210,019 | A * | 8/1940 | Zalkind | 312/108 |
| 3,974,898 | A * | 8/1976 | Tullis et al. | 312/111 |
| 5,378,029 | A | 1/1995 | Hoffeins | |
| 5,692,814 | A * | 12/1997 | Chou | 312/111 |
| 5,788,347 | A * | 8/1998 | Rabinovitz | 312/111 |
| 6,301,105 | B2 * | 10/2001 | Glorioso et al. | 361/679.34 |
| 7,165,767 | B2 * | 1/2007 | Graef et al. | 312/107 |
| 7,491,024 | B2 * | 2/2009 | Heinrichs et al. | 410/32 |
| 2002/0134700 | A1 | 9/2002 | Toguchi | |

FOREIGN PATENT DOCUMENTS

| | | |
|---|---|---|
| DE | 196 40 621 | 4/1998 |
| GB | 364871 | 1/1932 |
| GB | 1 496 444 | 12/1977 |
| JP | 62-70480 | 5/1987 |
| JP | 4-10376 | 1/1992 |
| JP | 2002-284168 | 10/2002 |
| JP | 2002-284169 | 10/2002 |
| JP | 2003-194022 | 7/2003 |

* cited by examiner

*Primary Examiner*—Michael P Ferguson
(74) *Attorney, Agent, or Firm*—Dickstein Shapiro LLP

(57) ABSTRACT

In an adjoining expansion structure for coupling adjacent devices together in a coupling direction, the adjoining expansion structure includes grooves which penetrate the adjacent devices in the coupling direction, respectively, and coupling members which are inserted in the grooves and fixed to the adjacent devices, respectively. The coupling members are adapted to engage together in the coupling direction. Each of the coupling members may includes a hook projectable from and retractable into a corresponding one of the adjacent devices and a receiving portion having a form adapted for receiving the hook in the coupling direction.

13 Claims, 5 Drawing Sheets

ADJOINING EXPANSION STRUCTURE

This application is based upon and claims the benefit of priority from Japanese patent application No. 2006-245047, filed on Sep. 11, 2006, the disclosure of which is incorporated herein in its entirely by reference.

BACKGROUND OF THE INVENTION

This invention relates to a structure enabling the adjoining expansion of devices (herein this is called an "adjoining expansion structure").

For example, when stacking a plurality of synthetic resin mold products, the adjoining expansion structure is often required for aligning the respective products and coupling them together.

A first related art will be described with reference to FIGS. 1A to 1C.

As shown in FIG. 1A, a parent device 31 is configured as a rectangular parallelepiped box and an expansion metal fitting 32 is configured as a rectangular plate. The expansion metal fitting 32 is provided with a total of four hooks 32*a* at two portions near the middle of its rear side and at two portions near rear corners of its left and right sides. The expansion metal fitting 32 is further provided with screw-fixing plate-like portions 32*b* at two portions near the middle of its front side. Further, holes 32*c* for insertion of screws are provided near four corners of the expansion metal fitting 32.

As indicated by downward arrows in FIG. 1A, the expansion metal fitting 32 is placed on an upper surface of the parent device 31 and fixed to the parent device 31 by four screws (not shown).

As shown in FIG. 1B, a child device 33 is configured as a rectangular parallelepiped box having the same size as the parent device 31. The child device 33 is provided with hook engaging portions (not shown) at portions corresponding to the four hooks 32*a* of the expansion metal fitting 32. The child device 33 is further provided with screw holes 33*a* at two portions near the middle of its front lower portion.

As shown in FIG. 1C, the child device 33 is placed on the expansion metal fitting 32 so that the hook engaging portions of the child device 33 engage the hooks 32*a* of the expansion metal fitting 32, respectively. Then, two screws 34 are inserted into the two screw-fixing plate-like portions 32*b* of the expansion metal fitting 32 and threaded into the two screw holes 33*a* of the child device 33. As a result, the child device 33 is coupled to the parent device 31. The expansion metal fitting 32 is seen between the devices 31 and 33.

A second related art will be described with reference to FIGS. 2A and 2B.

As shown in FIG. 2A, a parent device 41 is made of a synthetic resin and configured as a rectangular parallelepiped box. Hook engaging holes 41*a* are formed at three portions on one side of the parent device 41. A child device 42 is made of a synthetic resin and configured as a rectangular parallelepiped box. Hooks 42*a* are formed to project at three portions on one side of the child device 42.

The child device 42 is coupled to the parent device 41 as shown in FIG. 2B. Since an expansion metal fitting is not used between the devices 41 and 42, the design is not marred. However, since the hooks 42*a* and the hook engaging holes 41*a* are each part of the mold product, the structural strength is insufficient.

A third related art will be described (see, e.g. Japanese Unexamined Utility Model Application Publication (JP-U) No. Sho 62-70480). A plate member of a coupler has four pairs of L-shaped pawls and a pair of fixing pieces. After fitting the L-shaped pawls into coupling surfaces of two devices to be coupled together, the fixing pieces are screwed to the devices, respectively.

A fourth related art will be described (see, e.g. Japanese Unexamined Utility Model Application Publication (JP-U) No. Hei 04-10376). Using feet of an upper device housing and foot receivers of a lower device housing as positioning guide means, the housings are stacked together. In this event, L-shaped metal fittings of the upper device housing are brought into engagement with U-shaped metal fittings of the lower device housing, respectively. Then, fixing screws are respectively inserted into holes of the U-shaped metal fittings and holes of the L-shaped metal fittings and then tightened, so that the housings are fixedly coupled together.

A fifth related art will be described (see, e.g. Japanese Unexamined Patent Application Publication (JP-A) No. 2002-284168). When grips of a container box are respectively placed in grip cutout portions, engaging pawls are respectively brought into engagement with engaging rods of another container box located below. Accordingly, the two container boxes are coupled together. When the grips are raised from the grip cutout portions, the engaging pawls release the engagement with the engaging rods. Accordingly, the two container boxes are released from the coupling.

The first to fifth related arts each have at least one of the following drawbacks.

1. Since an expansion metal fitting coupling together a parent device and a child device is seen from the outside, the design properties of the devices are reduced.

2. The strength of a structure coupling together a parent device and a child device is weak.

3. The structure coupling together a parent device and a child device is complicated.

SUMMARY OF THE INVENTION

It is therefore an exemplary object of this invention to provide an adjoining expansion structure that is excellent in design, strong, and simple.

Other objects of the present invention will become clear as the description proceeds.

According to an exemplary aspect of the present invention, there is provided an adjoining expansion structure for coupling adjacent devices together in a coupling direction, the adjoining expansion structure comprising grooves which penetrate the adjacent devices in the coupling direction, respectively, and coupling members which are inserted in the grooves and fixed to the adjacent devices, respectively, wherein the coupling members are adapted to engage together in the coupling direction.

DESCRIPTION OF THE EXEMPLARY EMBODIMENTS

Referring to FIGS. 3A to 3D and 4A to 4D, a description will be given of an adjoining expansion structure according to a first exemplary embodiment of this invention.

Figure 1A:
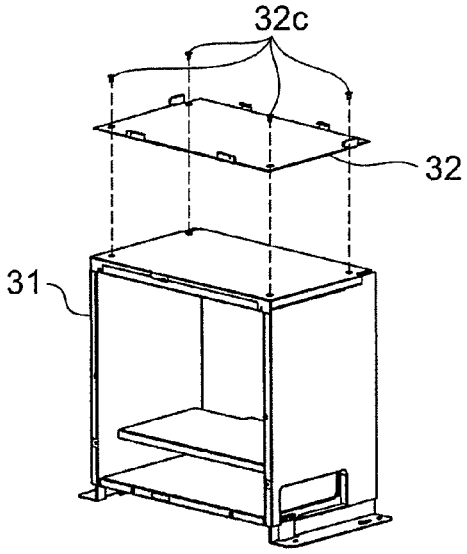
FIG. 1A PRIOR ART
FIG. 1A is a perspective view showing a state before an expansion metal fitting is fixed to a parent device in a first related art.
Figure 1B:
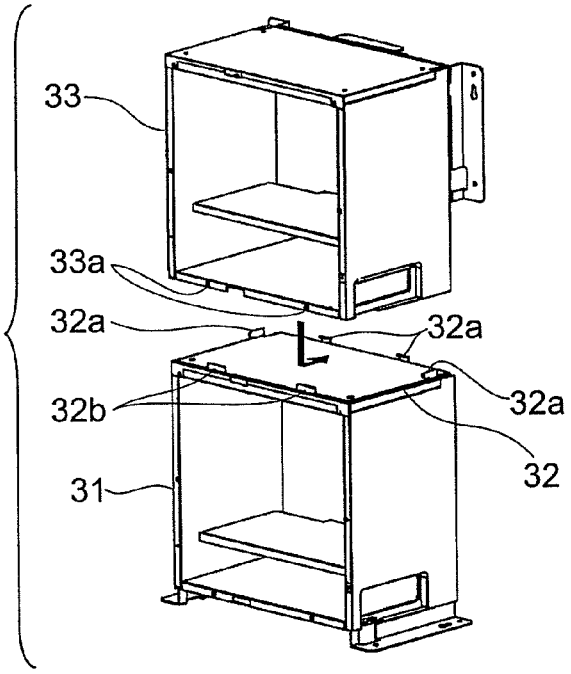
FIG. 1B PRIOR ART
FIG. 1B is a perspective view showing a state before a child device is fixed to the expansion metal fitting fixed to the parent device.
Figure 1C:
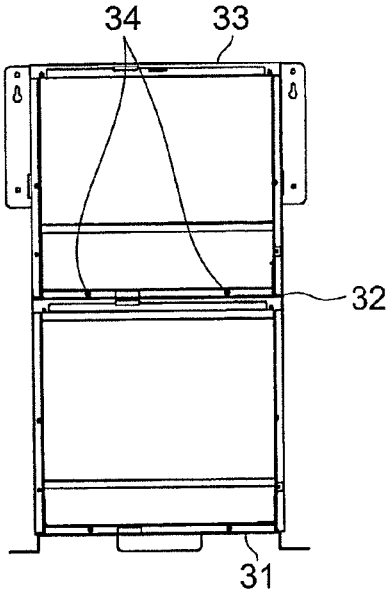
FIG. 1C PRIOR ART
FIG. 1C is a front view showing a state where the parent device and the child device are coupled together.
Figure 2A:
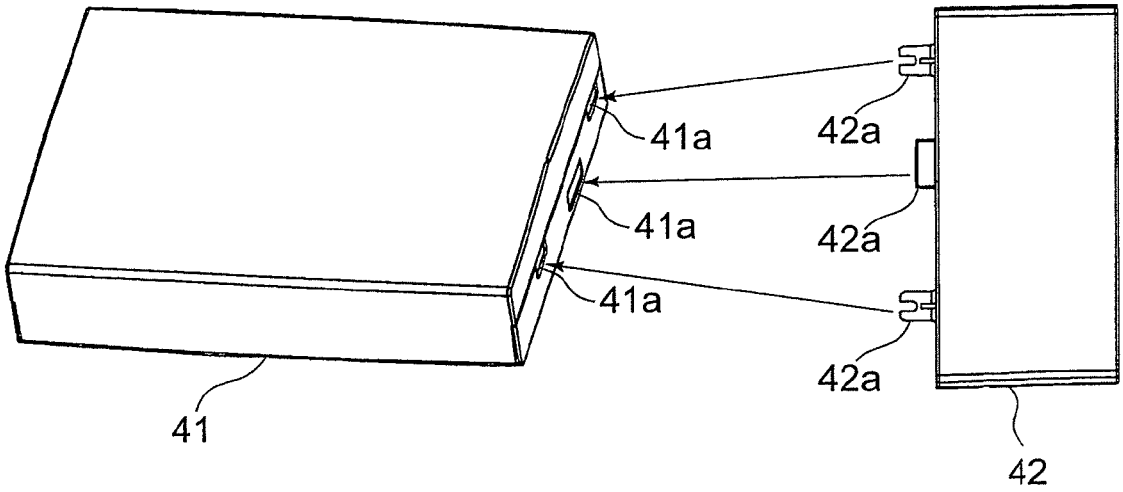
FIG. 2A PRIOR ART
FIG. 2A is a perspective view showing a state before a parent device and a child device are coupled together in a second related art.
Figure 2B:
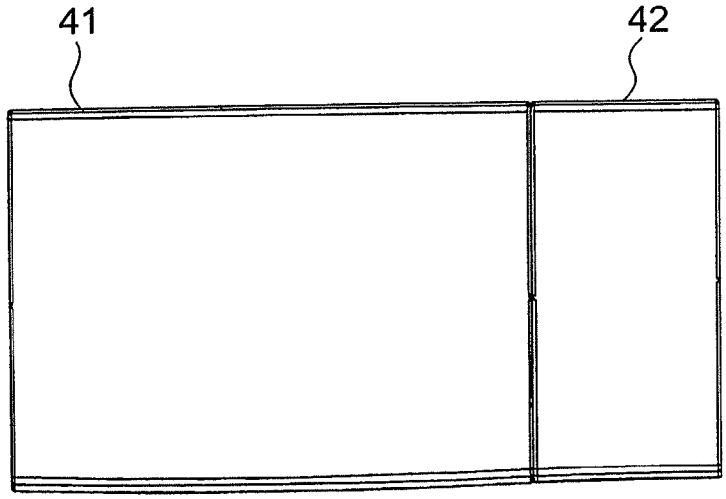
FIG. 2B PRIOR ART
FIG. 2B is a plan view showing a state where the parent device and the child device are coupled together.
Figure 3B:
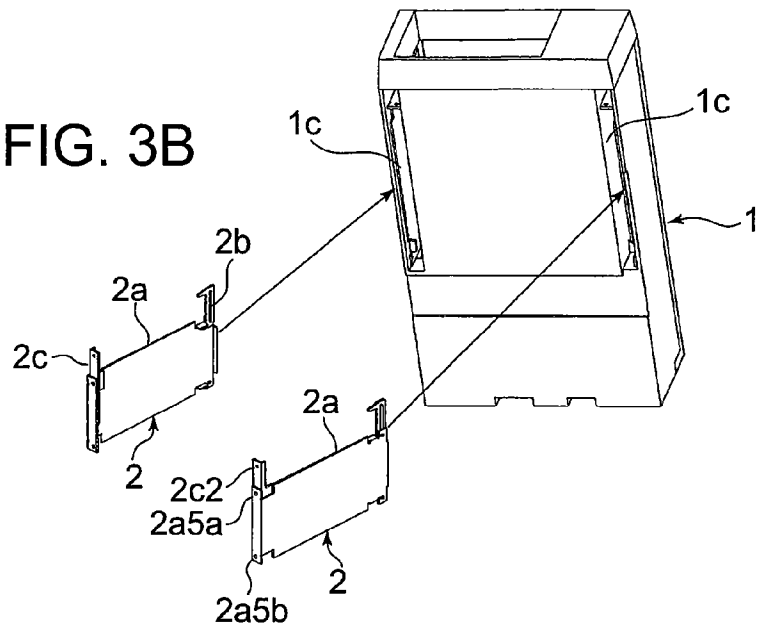
FIG. 3B is an exploded perspective view of the parent device.
Figure 3D:
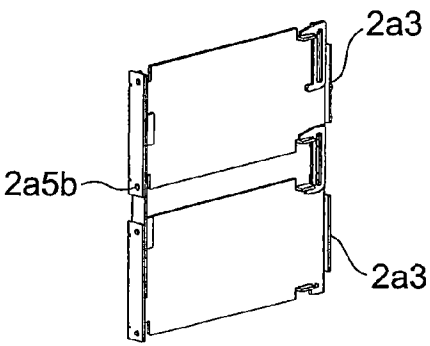
FIG. 3D is a perspective view showing a state where two expansion metal fittings included in the adjoining expansion structure are in engagement with each other.

A parent device 1 is configured as a rectangular parallelepiped box. As will be described in detail later, tip portions of hooks 2*b* and screw receiving plates 2*c* of a pair of (left and right) expansion metal fittings 2 project from openings 1*a* and 1*b* provided on both left and right sides of an upper surface of the parent device 1. The expansion metal fitting 2 on the left side and the expansion metal fitting 2 on the right side have shapes symmetrical with each other. As shown in FIG. 3B, grooves 1*c* for insertion of the pair of (left and right) expansion metal fittings 2 are provided on both left and right sides of the bottom of the parent device 1 near the front side thereof.

A child device 3 is configured as a rectangular parallelepiped box having the same size as the parent device 1. Openings 3*a* and 3*b* are provided on both left and right sides of an upper surface of the child device 3.

A description will be given of the sequence of stacking the child device 3 on the parent device 1 and coupling them together.

Figure 4A:
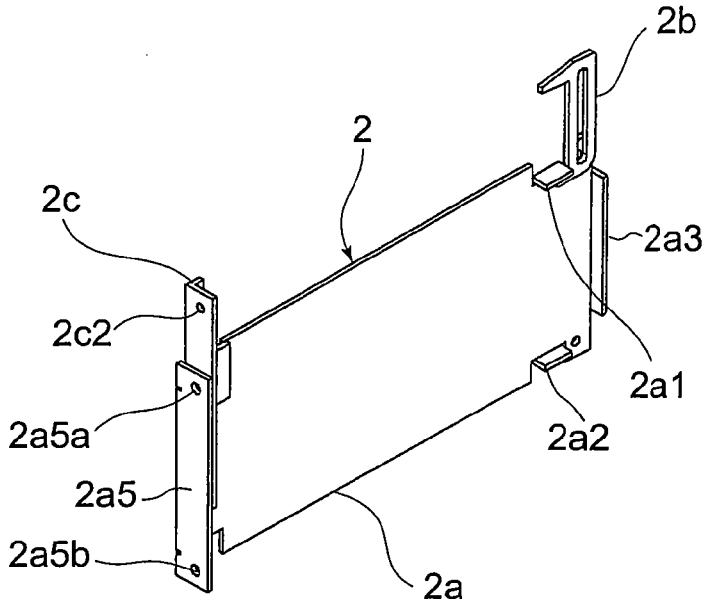
FIG. 4A is a perspective view showing a state where a hook and a screw receiving plate project from a base plate in the expansion metal fitting.
Figure 4C:
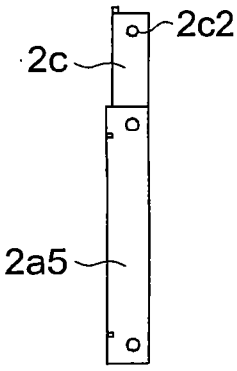
FIG. 4C is a left side view showing the same state.
Figure 4B:
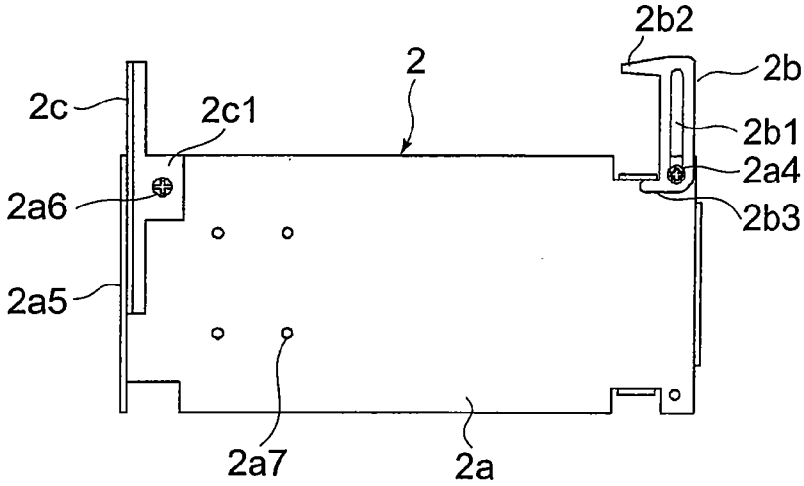
FIG. 4B is a front view showing the same state.

At first, the pair of expansion metal fittings 2 included in the adjoining expansion structure are respectively inserted into the pair of grooves 1*c* of the parent device 1 and fixed thereto. In this event, the hook 2*b* and the screw receiving plate 2*c* of each expansion metal fitting 2 project from its base plate 2*a* as shown in FIGS. 4A to 4C.

Figure 4D:
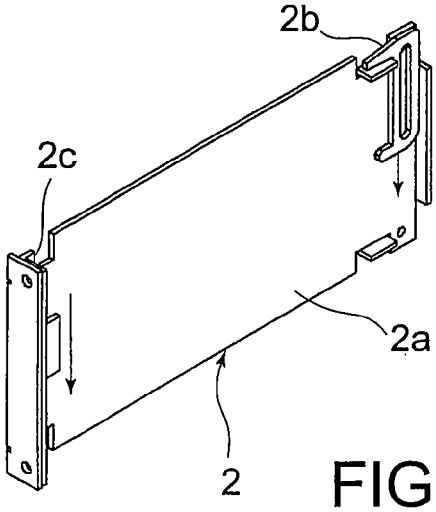
FIG. 4D is a perspective view showing a state where the hook and the screw receiving plate are retracted in the base plate in the expansion metal fitting.

Then, another pair of expansion metal fittings 2 are respectively inserted into a pair of grooves (not shown) of the child device 3 and fixed thereto. In this event, since the child device 3 is the uppermost device in the expansion, a hook 2*b* and a screw receiving plate 2*c* of each expansion metal fitting 2 are retracted in its base plate 2*a* as shown in FIG. 4D.

Figure 3A:
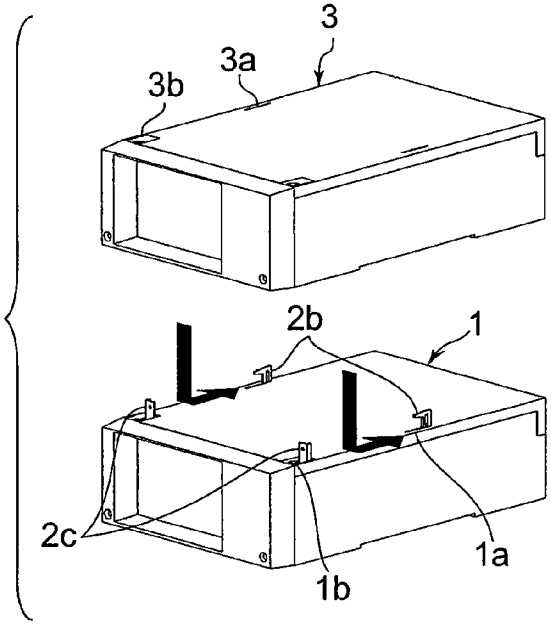
FIG. 3A is a perspective view showing a state before a parent device and a child device are coupled together using an adjoining expansion structure according to a first exemplary embodiment of this invention.
Figure 3C:
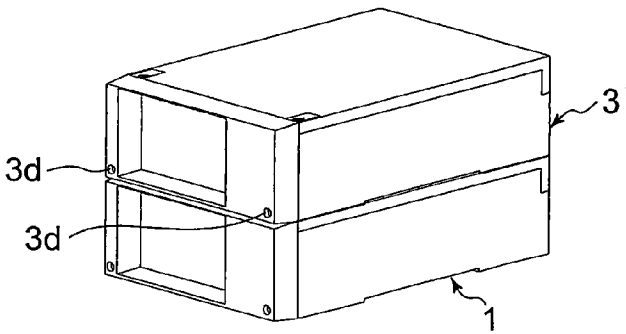
FIG. 3C is a perspective view showing a state where the parent device and the child device are coupled together.

Subsequently, by moving the lower surface of the child device 3 relative to the upper surface of the parent device 1 according to a pair of L-shaped arrows in FIG. 3A, the state shown in FIG. 3C is reached. In this state, the hooks 2*b* of the expansion metal fittings 2 fixed to the parent device 1 are respectively in engagement with hook receiving portions 2*a*2 of the expansion metal fittings 2 fixed to the child device 3.

Further, in this state, a screw (not shown) and a driver (not shown) are inserted into each of through holes 3*d* provided on both sides of the front lower portion of the child device 3. Then, by rotating the driver, the screw is threaded into a screw hole 2*a*5*b* of each of the expansion metal fittings 2 fixed to the child device 3 and a screw hole 2*c*2 of the screw receiving plate 2*c* of each of the expansion metal fittings 2 fixed to the parent device 1. Accordingly, the child device 3 is coupled to the parent device 1.

The expansion metal fitting 2 will be described in detail with reference to FIGS. 4A to 4D.

As shown in FIG. 4A, the expansion metal fitting 2 includes a generally rectangular base plate 2*a*, a hook 2*b* held on one end side of the base plate 2*a* so as to be slidable parallel to a short side thereof, and a screw receiving plate 2*c* held on the other end side of the base plate 2*a* so as to be slidable parallel to a short side thereof.

The base plate 2*a* has hook receiving portions 2*a*1 and 2*a*2 on both upper and lower sides thereof at portions each located near one end of each of long sides of the base plate 2*a*, a bent portion 2*a*3 along one of the short sides thereof, and a guide screw 2*a*4 near an upper portion of the same short side. Further, the base plate 2*a* has a bent portion 2*a*5 along the other short side and the bent portion 2*a*5 is provided with screw holes 2*a*5*a* and 2*a*5*b* near both upper and lower ends thereof.

The hook 2*b* has an elongated hole 2*b*1 extending in its sliding direction, a projection 2*b*2 at an upper-end side portion thereof, and a projection 2*b*3 at a lower-end side portion thereof.

As shown in FIGS. 4A to 4C, the screw receiving plate 2*c* is bent into a generally L-shape, formed with a rectangular convex portion 2*c*1 near the middle thereof, and provided with a screw hole 2*c*2 near an upper end thereof.

FIGS. 4A to 4C show the state where the hook 2*b* and the screw receiving plate 2*c* project upward from the base plate 2*a*. An expansion metal fitting 2 fixed to a device other than the uppermost device in the expansion is used in this state. The lower end of the elongated hole 2*b*1 of the hook 2*b* abuts against the guide screw 2*a*4 and the projection 2*b*3 of the hook 2*b* abuts against the upper hook receiving portion 2*a*1 of the expansion metal fitting 2. The projection 2*b*2 of the hook 2*b* engages the hook receiving portion 2*a*2 of the expansion metal fitting 2 fixed to the upper child device 3.

A description will be given of a method of retracting the hook 2*b* and the screw receiving plate 2*c* in the base plate 2*a*.

When the hook 2*b* is pushed downward by fingers, the hook 2*b* slides, while being guided by the guide screw 2*a*4 and the bent portion 2*a*3, until the projection 2*b*2 abuts against the hook receiving portion 2*a*1, and then stops at the position indicated in FIG. 4D.

Further, when the screw receiving plate 2*c* is pushed downward by fingers, after a screw 2*a*6 fixing the screw receiving plate 2*c* to the base plate 2*a* is removed using a driver, until the screw hole 2*c*2 coincides with the screw hole 2*a*5*a* of the base plate 2*a*, the screw receiving plate 2*c* slides while being guided by the bent portion 2*a*5 and reaches the position indicated in FIG. 4D. A screw (not shown) is threaded into the screw hole 2*a*5*a* and the screw hole 2*c*2 using the driver, thereby fixing the screw receiving plate 2*c* to the base plate 2*a*.

If the hook 2*b* can be fixed relative to the base plate 2*a* at its projected position and its retracted position by the guide screw 2*a*4, it is possible to omit the hook receiving portion 2*a*1.

Figure 5:
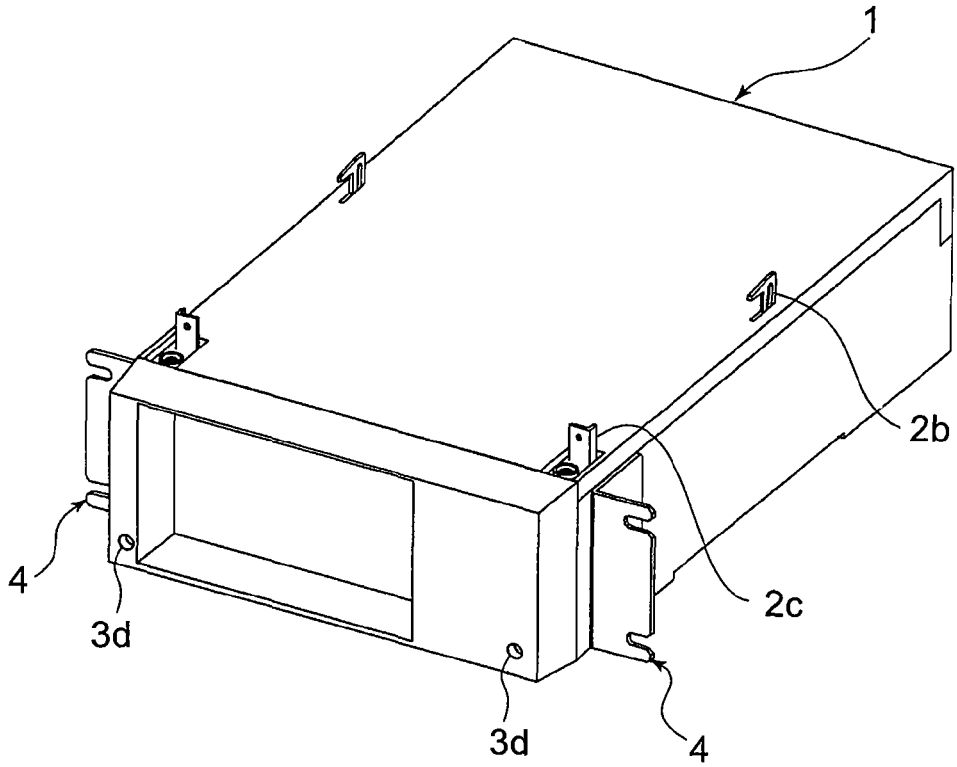
FIG. 5 is a perspective view of a parent device provided with an adjoining expansion structure according to a second exemplary embodiment of this invention.
Figure 6:
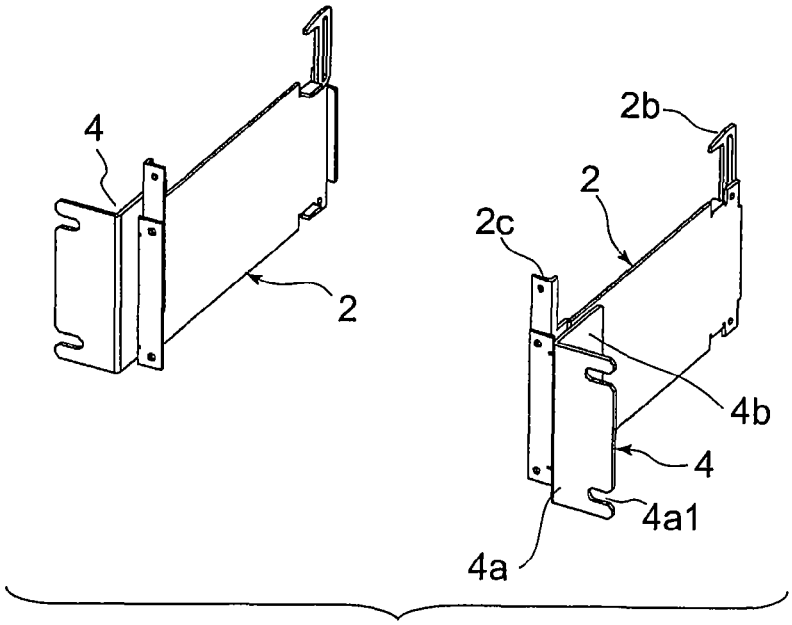
FIG. 6 is a perspective view of a pair of expansion metal fittings included in the adjoining expansion structure.

Referring to FIGS. 5 and 6, a description will be given of an adjoining expansion structure according to a second exemplary embodiment of this invention. The same reference symbols are assigned to the same or like portions, thereby omitting explanation thereof.

As shown in FIG. 6, 19-inch rack attaching metal fittings 4 are directly attached to the outer sides of left and right expansion metal fittings 2. Each of the rack attaching metal fittings 4 is formed by perpendicularly bending a plate and includes an attaching portion 4*a* to be attached to a rack and a fixing portion 4*b* to be fixed to the expansion metal fitting 2. The attaching portion 4*a* is formed with cutout portions 4*a*1 on both sides of its tip surface. The fixing portion 4*b* is fixed to the expansion metal fitting 2 by threading screws (not shown) into four screw holes 2*a*7 formed in a base plate 2*a* of the expansion metal fitting 2, as shown in FIG. 4B, through openings (not shown) provided on each of the left and right sides of a parent device 1. The rack attaching metal fitting 4 can also be used as an attaching metal fitting for attachment to equipment such as a wall.

In the adjoining expansion structure according to each of the first and second embodiments, two expansion metal fittings 2 are provided for each of the parent device 1 and the child device 3. However, depending on the size, strength, or structure of the parent device 1 and the child device 3, the design can be changed so that only one expansion metal fitting 2 is provided for each of the parent device 1 and the child device 3 on its one side (i.e. left side, right side, front side, rear side, upper side, or lower side) or in its middle.

The third exemplary embodiment of the invention is an adjoining expansion structure, wherein each of the coupling members comprises a hook which is projectable from and retractable into a corresponding one of the adjacent devices and a receiving portion having a form adapted for receiving the hook in the coupling direction.

The fourth exemplary embodiment of the invention is an adjoining expansion structure, wherein each of the first coupling members further comprises an additional receiving portion capable of receiving the hook in the coupling direction.

The fifth exemplary embodiment of the invention is an adjoining expansion structure, wherein each of the coupling members further comprises a base plate which is placed in each of the grooves and has a screw hole and a screw receiving plate which is connected to the base plate, wherein the screw receiving plate is projectable from and retractable into the corresponding one of the adjacent devices, and wherein the screw receiving plate has a screw hole having a form adapted for being screwed together with the screw hole of the base plate.

The sixth exemplary embodiment of the invention is an adjoining expansion structure, wherein the screw receiving plate is placed apart from the hook in a direction perpendicular to the coupling direction.

The seventh exemplary embodiment of the invention is an adjoining expansion structure, wherein the coupling members comprise a first and a second coupling metal fittings, each of the first and second coupling metal fittings has, on one end side thereof, a hook held so as to be projectable and retractable and one or two hook receiving portions and has, on the other end side thereof, a screw receiving plate held so as to be projectable and retractable and a first and a second screw hole, the screw receiving plate has a third screw hole, the hook of the first coupling metal fitting, in its projected state, engages one of the hook receiving portions of the second coupling metal fitting, the screw, in a projected state of the screw receiving plate of the first coupling metal fitting, is threaded into the second screw hole of the second coupling metal fitting and the third screw hole of the screw receiving plate of the first coupling metal fitting using the driver, and the screw, in a retracted state of the screw receiving plate of the first coupling metal fitting, is threaded into the first screw hole of the first coupling metal fitting and the third screw hole of the screw receiving plate of the first coupling metal fitting using the driver.

The eighth exemplary embodiment of the invention is an adjoining expansion structure, wherein each of the adjacent devices as, in addition to the groove and the through hole, another groove and another through hole, the groove and the another groove being located near both sides of each of the adjacent devices and the through hole and the another through hole being located near both sides of each of the adjacent devices.

The ninth exemplary embodiment of the invention is an adjoining expansion structure, wherein the hook of the first coupling metal fitting has an elongated hole for guiding at the time of projection and retraction thereof and a projection for engaging the one of the hook receiving portions of the second coupling metal fitting.

The tenth exemplary embodiment of the invention is an adjoining expansion structure, wherein each of the adjacent devices has, in addition to the groove and the through hole, another groove and another through hole, the groove and the another groove being located near both sides of each of the adjacent devices and the through hole and the another through hole being located near both sides of each of the adjacent devices.

The eleventh exemplary embodiment of the invention is an adjoining expansion structure, wherein the hook of the first coupling metal fitting has an elongated hole for guiding at the time of projection and retraction thereof, a first projection for engaging the other of the hook receiving portions of the first coupling metal fitting in a retracted state of the hook of the first coupling metal fitting, and a second projection for engaging the other of the hook receiving portions of the first coupling metal fitting in the projected state of the hook of the first coupling metal fitting.

The twelfth exemplary embodiment of the invention is an adjoining expansion structure, wherein each of the adjacent devices has, in addition to the groove and the through hole, another groove and another through hole, the groove and the another groove being located near both sides of each of the adjacent devices and the through hole and the another through hole being located near both sides of each of the adjacent devices.

The thirteenth exemplary embodiment of the invention is an adjoining expansion structure, wherein each of the screw receiving plates is bent into a generally L-shape, is detachably fixed to a base plate of the corresponding one of the first and second coupling metal fittings, and has the third screw hole near one end thereof.

The fourteenth exemplary embodiment of the invention is an adjoining expansion structure, wherein each of the adjacent devices has, in addition to the groove and the through hole, another groove and another through hole, the groove and the another groove being located near both sides of each of the adjacent devices and the through hole and the another through hole being located near both sides of each of the adjacent devices.

The fifteenth exemplary embodiment of the invention is an adjoining expansion structure, wherein each of the adjacent devices is formed with openings on both sides thereof, attaching metal fittings are respectively fixed to the first and second coupling metal fittings through the openings, and each of the attaching metal fittings is formed by perpendicularly bending a plate and has an attaching portion for attachment to equipment and a fixing portion for fixation to the corresponding one of the first and second coupling metal fittings.

The sixteenth exemplary embodiment of the invention is an adjoining expansion structure, wherein the adjacent devices have the same size as each other.

The exemplary advantages according to the invention are:

1. Since expansion metal fittings coupling a plurality of devices together are not seen from the outside, the total design properties of the devices are improved;

2. Since the expansion metal fittings coupling the devices together are each configured as having a hook and a screw receiving plate, the coupling structure is strong and stable;

3. The coupling structure is achieved by inserting and fixing the expansion metal fittings in grooves of the respective devices and thus is simple and low in cost; and 4. The devices can be easily coupled together by rotating a screw using a driver.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. An adjoining expansion structure for coupling adjacent devices together in a coupling direction, each device having at least one groove which penetrates the device in the coupling direction and is aligned with a groove of the other device, the adjoining expansion structure comprising:

at least one pair of first and second coupling fittings, each of the first and second coupling fittings being adapted for insertion into a respective one of a pair of aligned grooves of the adjacent devices, wherein said first and second coupling fittings are adapted to connectively engage one another in the coupling direction to couple the devices, each said coupling fitting comprising:

a base having upper and lower ends in the coupling direction and first and second end sides;

a hook movably mounted to the base on the first end side thereof so that the hook is projectable and retractable from the upper end in the coupling direction;

a hook receiving portion disposed on the first end side of the base adjacent the lower end and adapted for receiving the hook of another said coupling fitting;

first and second screw holes in the second end side of the base adjacent the upper and lower ends, respectively;

a screw receiving plate having a third screw hole and moveably mounted to the base on the second end side thereof so as to be projectable and retractable from the upper end of the base in the coupling direction; and a screw;

said first coupling fitting being aligned with said second coupling fitting such that:

the hook of said first coupling fitting, in a projected state, engages the hook receiving portion of said second coupling fitting;

in a projected state of the screw receiving plate of said first coupling fitting, the screw is threaded into the second screw hole of said second coupling fitting and the third screw hole of the screw receiving plate of said first coupling fitting; and in a retracted state of the screw receiving plate of said first coupling fitting, the screw is threaded into the first screw hole of said first coupling fitting and the third screw hole of the screw receiving plate of said first coupling fitting.

2. The adjoining expansion structure according to claim 1, wherein the base of each of said coupling fittings is a plate-shape and wherein the hook of each of said coupling fittings is movably mounted to said base so as to be projectable into and retractable from a corresponding one of the adjacent devices.

3. The adjoining expansion structure according to claim 2, wherein each of the coupling fitting further comprises:

wherein the screw receiving plate is movably mounted to said base plate so as to be projectable into and retractable from the corresponding one of the adjacent devices, and wherein the screw receiving plate has a fourth screw hole having a form adapted for being screwed together with the first screw hole of the base plate.

4. The adjoining expansion structure according to claim 3, wherein in each coupling fitting the screw receiving plate is located distal from the hook in a direction perpendicular to the coupling direction.

5. The adjoining expansion structure according to claim 1, wherein the adjoining expansion structure is attached to two adjacent devices, each said device having first and second grooves which penetrate a lower surface of said device in the coupling direction at opposing sides thereof, and corresponding to each groove, first and second through holes which penetrate an upper surface of the device and extend into the groove, one of said coupling fittings being received within each groove such that the hook and the screw receiving plate of said coupling fitting is projectable through a respective one of the first and second through holes.

6. The adjoining expansion structure according to claim 1, wherein the hook of the first coupling fitting has an elongated hole for guiding projection and retraction thereof and a projection for engaging the hook receiving portions of the second coupling metal fitting.

7. The adjoining expansion structure according to claim 6, wherein the adjoining expansion structure is attached to two adjacent devices, each said device having first and second grooves which penetrate a lower surface of said device in the coupling direction at opposing sides thereof, and corresponding to each groove, first and second through holes which penetrate an upper surface of the device and extend into the groove, one of said coupling fittings being received within each groove such that the hook and the screw receiving plate of said coupling fitting is projectable through a respective one of the first and second through holes.

8. The adjoining expansion structure according to claim 1, wherein each coupling fitting comprises a second hook receiving portion disposed on the first end side of the base plate adjacent the upper end and wherein the hook of the first coupling fitting has an elongated hole for guiding projection and retraction thereof, a first projection second hook receiving portion of the first coupling fitting in a retracted state of the hook of the first coupling fitting, and a second projection for engaging the second hook receiving portion of the first coupling. fitting in the projected state of the hook of the first coupling fitting.

9. The adjoining expansion structure according to claim 8, wherein the adjoining expansion structure is attached to two adjacent devices, each said device having first and second grooves which penetrate a lower surface of said device in the coupling direction at opposing sides thereof, and corresponding to each groove, first and second through holes which penetrate an upper surface of the device and extend into the groove, one of said coupling fittings being received within each groove such that the hook and the screw receiving plate of said coupling fitting is projectable through a respective one of the first and second through holes.

10. The adjoining expansion structure according to claim 1, wherein each of the screw receiving plates is bent into a generally L-shape, is detachably fixed to a base plate of the corresponding one of the first and second coupling fittings, and has the third screw hole near one end thereof.

11. The adjoining expansion structure according to claim 10, wherein the adjoining expansion structure is attached to two adjacent devices, each said device having first and second grooves which penetrate a lower surface of said device in the coupling direction at opposing sides thereof, and corresponding to each groove, first and second through holes which penetrate an upper surface of the device and extend into the groove, one of said coupling fittings being received within each groove such that the hook and the screw receiving plate of said coupling fitting is projectable through a respective one of the first and second through holes.

12. The adjoining expansion structure according to claim 11, wherein each said device has first and second openings in opposing side surfaces of said device, each opening extending into a respective one of said grooves, and an attaching fitting fixed to each respective said coupling fitting through the openings, each attaching fitting being a perpendicularly bent plate and having an attaching portion for attachment to equipment and a fixing portion for fixation to said respective coupling fitting.

13. The adjoining expansion structure according to claim 1, wherein the adjoining expansion structure is attached to two adjacent devices and the adjacent devices have the same size as each other

* * * * *